United States Patent [19]

Eckel

[11] 3,961,723

[45] June 8, 1976

[54] RECEPTACLE WITH SLIDING COVER

[75] Inventor: Alan Eckel, Westford, Mass.

[73] Assignee: Eckel Industries, Inc., Cambridge, Mass.

[22] Filed: July 12, 1974

[21] Appl. No.: 487,878

[52] U.S. Cl. ..... 220/331; 220/335

[51] Int. Cl.[2] ..... B65D 43/14

[58] Field of Search ..... 220/331, 335, 332, 333, 220/334

[56] References Cited

UNITED STATES PATENTS

| | | | |
|---|---|---|---|
| 2,338,477 | 1/1944 | Wolters | 220/331 |
| 2,569,254 | 9/1951 | Page | 220/331 |
| 2,661,119 | 12/1953 | Spiess | 220/335 |
| 2,682,351 | 6/1954 | Durand | 220/331 |

*Primary Examiner*—Ro E. Hart

*Attorney, Agent, or Firm*—Schiller & Pandiscio

[57] ABSTRACT

A receptacle has a cover therefor with connector plates attached to opposite sides of said cover. Slideway guides are attached to opposite sides of said receptacle and they provide runways for channel members that are connected to said connector plates. Rails are pivotally attached to opposite sides of said slideway guides and said channel members slide on them. A stop member on said receptacle terminates the opening movement of the cover.

10 Claims, 6 Drawing Figures

RECEPTACLE WITH SLIDING COVER

The principal object of my invention is to provide a cover for a receptacle that is relatively heavy and which, when pushed rearwardly, automatically slides to open position and maintains that open position, and likewise, when pulled forwardly, can be slid easily to closed position, thus avoiding having to lift the cover at any time.

The foregoing and other objects, which will appear as the nature of the invention is better understood, may be accomplished by a construction, combination and arrangement of parts such as is disclosed by the drawing. The nature of the invention is such as to render it susceptible to various changes and modifications, and, therefore, I am not to be limited to the construction disclosed by the drawing nor to the particular parts described in the specification; but am entitled to all such changes therefrom as fall within the scope of my invention.

Figure 1:
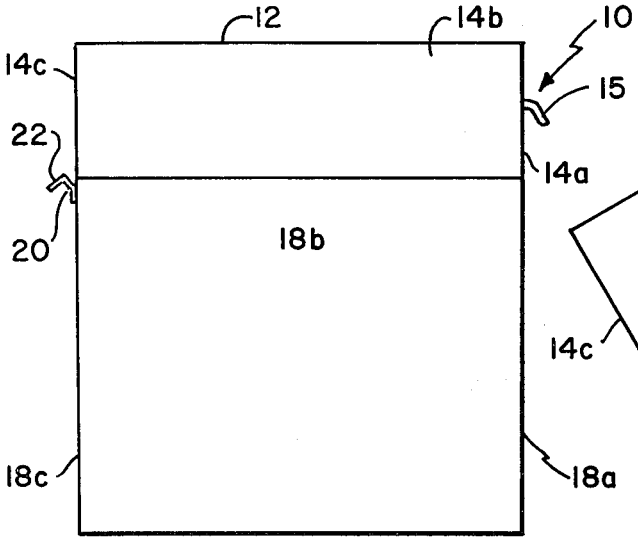
FIG. 1 is a side elevational view of my receptacle with the cover in closed position.

As illustrated, a cover 10 has a top 12 and side means shown as four sides 14*a*, 14*b*, 14*c* and 14*d* extending from said top downwardly. A handle 15 extends from said front side 14*a*. This cover sits on a sealing gasket 19 extending around the top edge of a receptacle 18 and closes the latter. Said receptacle has side means shown as four sides 18*a*, 18*b*, 18*c* and 18*d*. A stop member 20 is attached to the receptacle rear side 18*c* and it has a diagonally slanting outer end portion 22, later referred to. Connector plates 24 and 26 are fixedly attached to the inner surfaces of oppositely disposed cover sides 14*b* and 14*d*, and slides in the form of channel members 28 and 30 are respectively and fixedly attached to said connector plates 24 and 26. Said channel members slide on runways 52 later referred to. Rails 32 and 34 are pivotally attached as at 38 to opposite sides of slideway guides 42 and 44 respectively and said channel members slide on them. The guides 42 and 44 are attached respectively to opposite receptacle sides 18*b* and 18*d*, and they extend from the rear of the latter.

Slideway guide 42 has an upstanding side 46, an intermediate member 48 extending therefrom, and a base 50 extending from the latter. The other guide 44 has similar parts. Said base 50 is riveted as at 61 to said receptacle side 18*b*. Said intermediate member 48 provides a runway 52 for said channel members. Rollers in the form of spindle bearings 54 and 56 are attached to the upstanding sides 46 of guides 42 and 44 and also to said receptacle sides 18*b* and 18*d*, which make easier the sliding of said channel members.

Figure 3:
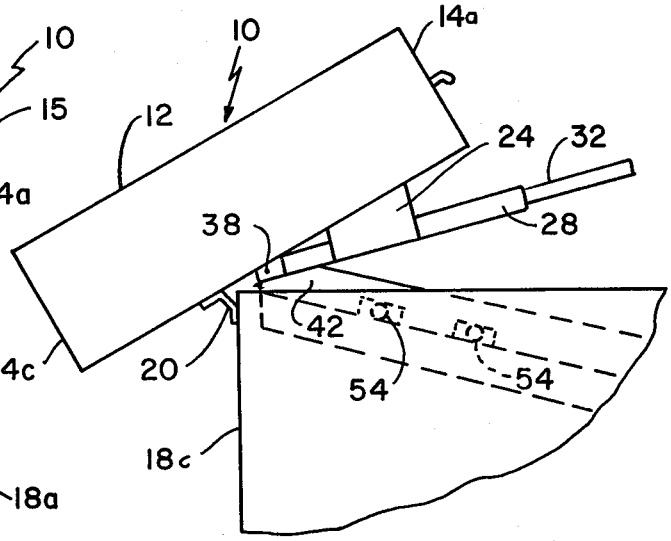
FIG. 3 is a side elevational view similar to FIG. 2; but with the cover fully open.
Figure 2:
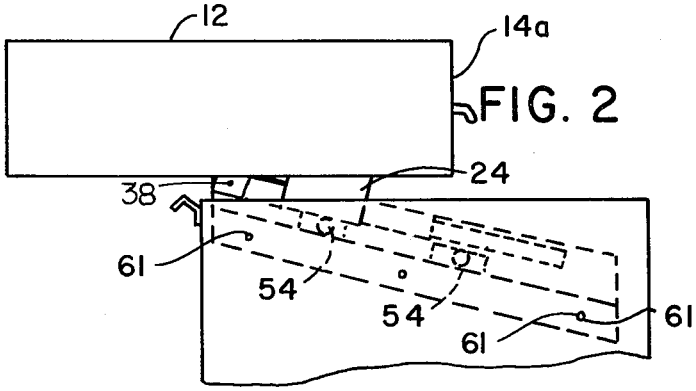
FIG. 2 is a side elevational view of said receptacle with the cover partly open.
Figure 4:
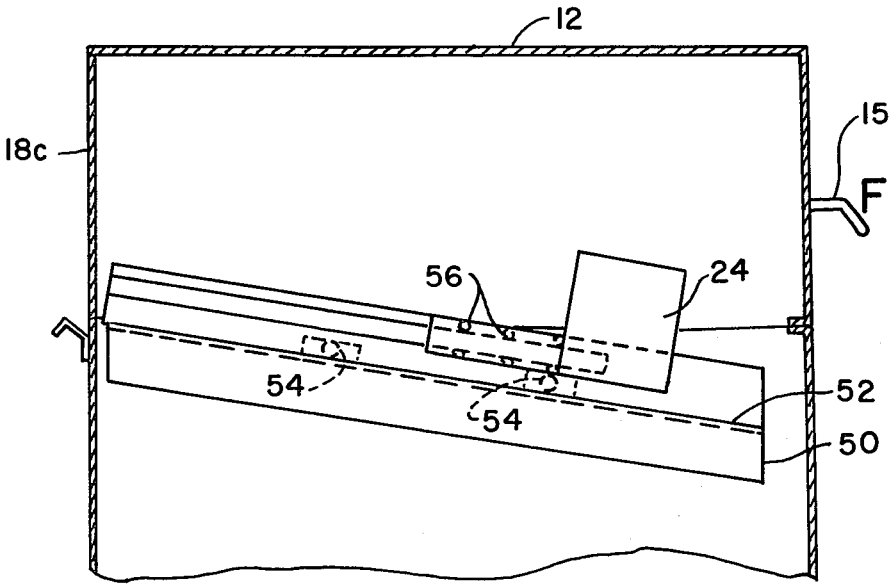
FIG. 4 is a diagrammatic view of my receptacle with the cover in closed position.
Figure 6:
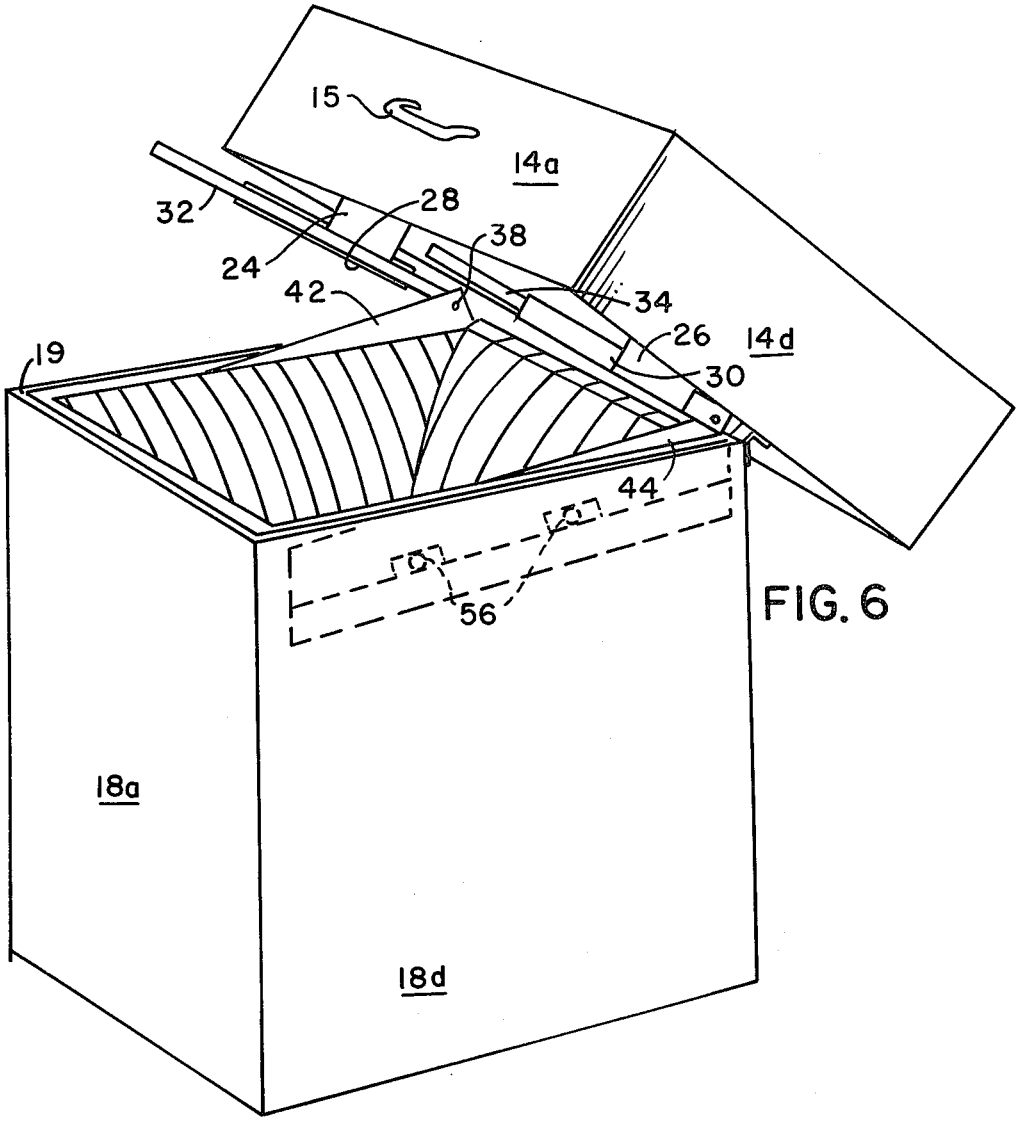
FIG. 6 is a perspective view, greatly enlarged, with the cover fully open.
Figure 5:
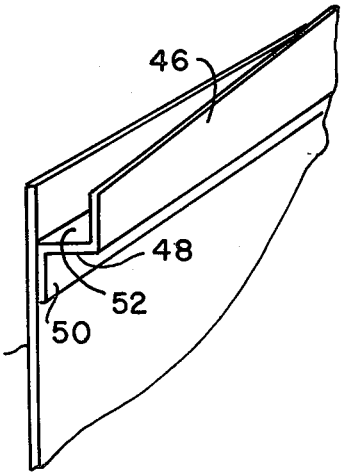
FIG. 5 is a perspective, fragmentary view of a slideway guide shown attached to a side of the receptacle.

In operation, the cover, when closed, may be opened by pushing it rearwardly from the front. Said channel members 28 and 30 slide on said slideway guides 42 and 44 rearwardly and upwardly, thus releasing pressure on the said gasket seal. Said rails 32 and 34 move upwardly along with said cover. When more than one-half of the weight of the cover passes said pivot point 38 said cover reaches said stop member outer end portion 22. At this point more than one-half of the weight of the cover is beyond said pivot point 38, as shown in FIG. 3, and the cover comes to rest in its fully open position.

To close the cover it is pulled forwardly and thus said channel members and rails rest on said slideway guides 42 and 44, and the momentum developed by this movement carries the cover 14 to closed position. The closing action is facilitated by said rollers 54 and 56 positioned along said slideways.

What I claim is:

1. A receptacle, a cover for said receptacle, and means connecting said cover to said receptacle for facilitating moving of said cover between open and closed positions relative to said receptacle, said connecting means comprising (a) first and second inclined slideway guides attached to first and second opposite sides respectively of said receptacle, (b) first and second rails pivotally attached to said first and second guides respectively, (c) first and second slide members slidably mounted on said first and second rails respectively, and (d) first and second connector members attached respectively to first and second opposite sides of said cover and also to said first and second slide members, said connecting means being arranged so that (1) said slide members extend along said guides when said cover is in closed position and (2) pushing said cover from its closed position so as to force said slide members to slide along said guides on said rails toward the pivot points of said rails will cause the weight of said cover to pivot said rails in a direction whereby said weight will assist said cover to reach open position.

2. A receptacle and cover therefor as set forth in claim 1, said guides each having three integral angular portions with one portion being a base member attached to one of said receptacle sides and another portion extending laterally from said base member and providing a runway for said slide members.

3. A receptacle and cover therefor as set forth in claim 2, wherein each of said guides has a third portion extending in upstanding position above said another portion.

4. A receptacle and cover therefor as set forth in claim 1, and bearings attached to said guides in position to be engaged by said slide members when said cover is closed on said receptacle.

5. A receptacle and cover therefor as set forth in claim 1, and a stop member attached to a side of said receptacle at the rear thereof and positioned to intercept said cover when said cover is moved to open position.

6. A receptacle and cover therefor as set forth in claim 5, said stop member having an outer end portion slanting diagonally and outwardly away from said receptacle.

7. A receptacle, a cover for said receptacle, and means connecting said cover to said receptacle for facilitating moving said cover between open and closed positions relative to said receptacle; said means comprising first and second inclined slideway guides secured to first and second opposite sides of said receptacle, first and second rails, means pivotally attaching said first and second rails to said first and second opposite sides respectively of said receptacle, and first and second slide members secured to opposite sides of said cover and slidably mounted to said first and second rails respectively, the connections between said slide members and said cover and the dispositions of said rails and guides being such that (1) said guides are slidably engaged by said slide members when said cover is in closed position, (2) said guides urge said slides to lift said cover as said cover commences to move out of its closed position; and (3) progressively shifting the positions of said slide members on said rails toward the pivot points of said rails causes the weight of said cover to assist movement of said cover to open position.

8. Apparatus according to claim 7, wherein said guides are inclined forward to rear relative to said receptacle and said rails are pivotally attached to the rear ends of said guides.

9. Apparatus according to claim 7 wherein said cover is disposed at an acute angle relative to said slide members and said rails.

10. Apparatus according to claim 7 wherein said slide members are attached to said cover adjacent its forward end and said rails are attached to said guides adjacent to the rear end of said receptacle.

* * * * *